US008708673B1

(12) United States Patent
McNulty et al.

(10) Patent No.: US 8,708,673 B1
(45) Date of Patent: Apr. 29, 2014

(54) INLINE SHAFT DRIVEN DRAFT INDUCER

(76) Inventors: Timothy Edward McNulty, Dallas, TX (US); Thaddeus James Rohskopf, Marietta, GA (US)

( * ) Notice: Subject to any disclaimer, the term of this patent is extended or adjusted under 35 U.S.C. 154(b) by 838 days.

(21) Appl. No.: 12/335,257

(22) Filed: Dec. 15, 2008

Related U.S. Application Data

(60) Provisional application No. 61/013,773, filed on Dec. 14, 2007.

(51) Int. Cl.
*F04D 29/046* (2006.01)

(52) U.S. Cl.
USPC ..... 417/423.1; 417/321

(58) Field of Classification Search
USPC ..... 123/198; 417/423.6, 321; 454/339–343
See application file for complete search history.

(56) References Cited

U.S. PATENT DOCUMENTS

| | | | | |
|---|---|---|---|---|
| 1,992,891 | A * | 2/1935 | Schmidt | 452/80 |
| 2,679,972 | A * | 6/1954 | Brumme | 417/423.1 |
| 3,028,688 | A * | 4/1962 | Ebert | 434/392 |
| 3,799,690 | A * | 3/1974 | Klaas | 415/72 |
| 4,373,482 | A * | 2/1983 | Goscenski, Jr. | 123/198 R |
| 6,860,057 | B1 * | 3/2005 | Petaja-Suvanto | 43/4 |

* cited by examiner

*Primary Examiner* — Nimeshkumar Patel
*Assistant Examiner* — Jacob R Stern
(74) *Attorney, Agent, or Firm* — Lathrop & Gage LLP

(57) ABSTRACT

Draft inducers are set forth herein. According to one embodiment, a draft inducer for use with corrosive and high temperature gas includes an inline tubular housing, an impeller inside the housing, and a motor outside the housing. A drive shaft couples the motor to the impeller to rotate the impeller with force from the motor. According to another embodiment, an inline shaft driven draft inducer includes an inline tubular housing, a rotating member, a motor, and a drive shaft. The housing has an external perimeter, and the motor is outside the housing external perimeter. The rotating member is inside the housing, and the drive shaft couples the motor to the rotating member to spin the rotating member with force from the motor.

20 Claims, 6 Drawing Sheets

100 →

← 200

300 →

INLINE SHAFT DRIVEN DRAFT INDUCER

RELATED APPLICATIONS

This application claims priority to provisional U.S. Patent Application Ser. No. 61/013,773, filed Dec. 14, 2007, the disclosure of which is incorporated herein by reference.

BACKGROUND

There are a few types of fans being marketed to exhaust corrosive or high temperature gas. The three main types of fans that are currently produced are the utility set fan (FIGS. 1*a* and 1*b*), the belt driven tube fan (FIG. 2), and the bifurcated fan (FIG. 3). These prior art fans are generally expensive and/or cumbersome and are discussed in further detail below.

A utility set fan 100, as shown in FIG. 1*a*, usually sits on a frame, and the fan wheel is directly driven by a motor with the fan housing wall separating the two. The fan wheel is centrifugal-type, with a scroll housing that forces the designer to exhaust the gas at a ninety degree angle from the inlet gas stream (FIG. 1*b*). Adding the ninety degree angle can be very cumbersome for the ducting designer to work into a duct layout.

A belt driven tube fan 200, as shown in FIG. 2, utilizes a straight-through tube design that can be placed anywhere in the ducting system, unlike the utility set fan discussed above. However, the motor must be placed outside of the air-stream to avoid over-heating or corrosion by the exhaust gasses. To move the motor outside of the air-stream, a belt driven pulley system is used to drive the fan wheel. Belts are undesirable, as they are difficult to maintain and inefficient.

A bifurcated fan 300, as shown in FIG. 3, is a hybrid of the utility set fan and the belt driven tube fan. The bifurcated fan places the motor inline with the air-stream in a tube-like manner, but protects the motor by bifurcating the gas stream and creating a motor housing which is outside of the gas stream. While this solves some problems associated with the utility set fan and the belt driven tube fan, the fan size required is often larger than the utility set or the tube fan due to the enormous pressure drop created by the motor housing.

SUMMARY

Draft inducers are set forth herein. According to one embodiment, a draft inducer for use with corrosive and high temperature gas includes an inline tubular housing, an impeller, a motor, and a drive shaft. The impeller is inside the housing, and the motor is outside the housing. The drive shaft couples the motor to the impeller to rotate the impeller with force from the motor.

According to another embodiment, an inline shaft driven draft inducer includes an inline tubular housing, a rotating member, a motor, and a drive shaft. The housing has an external perimeter, and the motor is outside the housing external perimeter. The rotating member is inside the housing, and the drive shaft couples the motor to the rotating member to spin the rotating member with force from the motor.

DETAILED DESCRIPTION

Figure 1A:
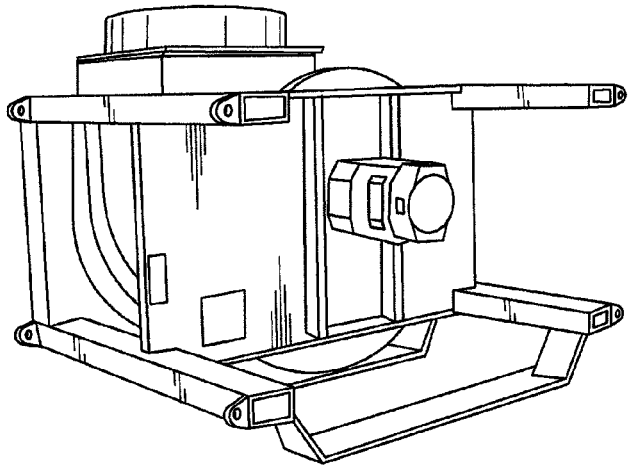
FIG. 1a PRIOR ART
FIG. 1*a* shows a perspective view of a PRIOR ART device.
Figure 2:
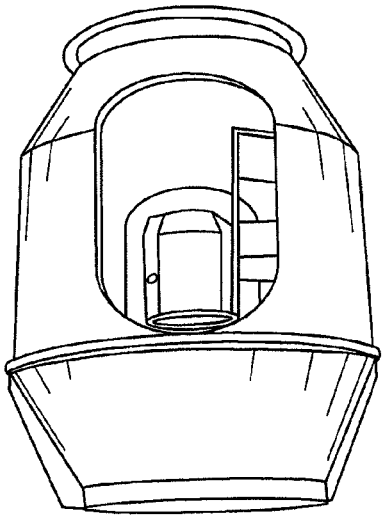
FIG. 2 PRIOR ART
FIG. 2 shows a perspective view of another PRIOR ART device.
Figure 3:
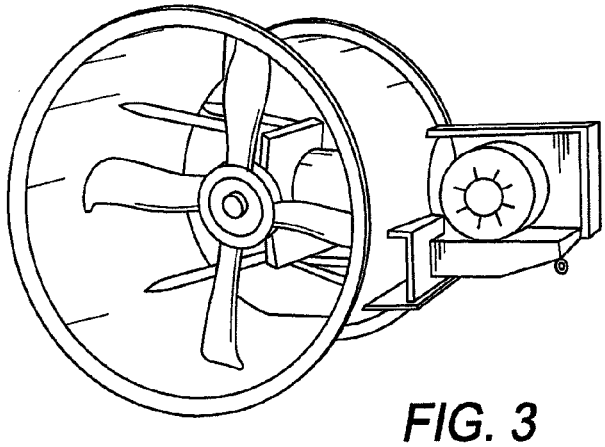
FIG. 3 PRIOR ART
FIG. 3 shows a perspective view of yet another PRIOR ART device.
Figure 1B:
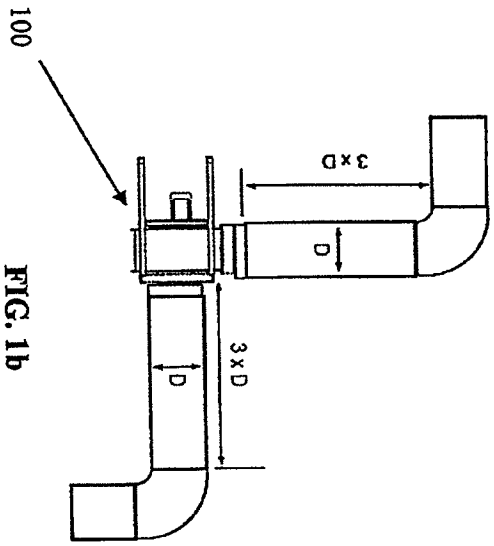
FIG. 1b PRIOR ART
FIG. 1*b* shows a schematic view of the PRIOR ART device of FIG. 1 in use.
Figure 4:
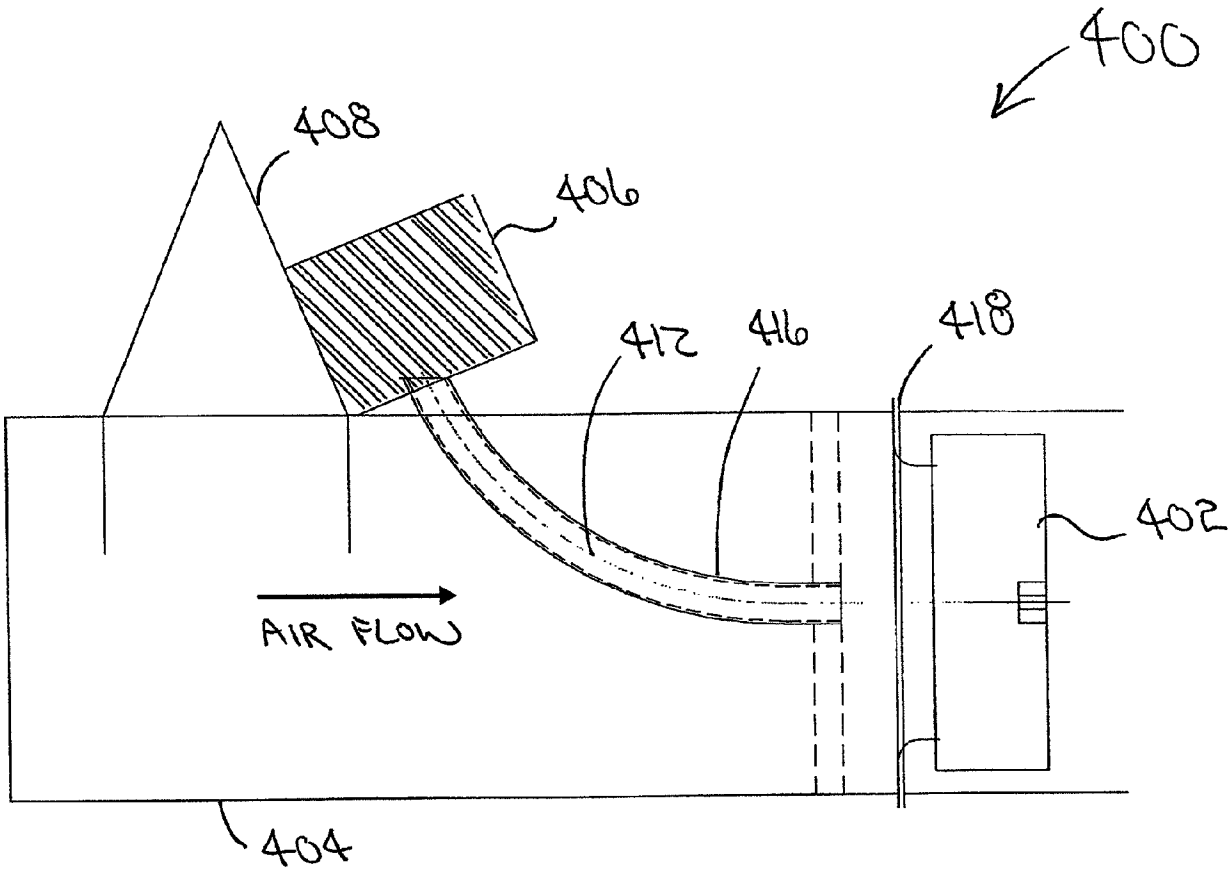
FIG. 4 shows a schematic view of a draft inducer according to an embodiment.

As shown in FIG. 4, a draft inducer 400 according to one embodiment has an impeller 402 inside a tubular housing 404 and a motor 406 outside the housing 404. The housing 404 may be constructed of material chosen, for example, due to intended use, weight, cost, availability, and/or other factors. For example, materials that can withstand very high temperatures as well as corrosive gasses, such as 316L SS, AL29-4C, and 14 gauge 6061T Aluminum may be appropriate. The impeller 402 may be any appropriate impeller type, and some embodiments may substitute a propeller for the impeller 402. Similar to the housing 404, the impeller 402 may be constructed of 316L SS, AL29-4C, 14 gauge 6061T Aluminum, and/or other material. The motor 406 may be selected based on desired output, reliability, efficiency, cost, and/or other factors.

The motor 406 is attached to a mount 408 that is angled relative to the housing 404 so that an output 410 (FIG. 5) of the motor 406 is not perpendicular to the housing 404. A flexible drive shaft 412 passes through a hole 414 (FIG. 5) in the housing 404 and directly couples the motor 406 (i.e., the output 410) to the impeller 402. By directly coupling the motor 406 to the impeller 402, the flexible drive shaft 412 may allow the motor 406 to rotate the impeller 402 without any amount of slippage and with minimal or no need for maintenance. The motor 406 may be mounted (e.g., on the mount 408) at approximately a twenty degree to forty-five degree angle (for example) outside of the gas stream (i.e., outside the housing 404) to reduce the torsional load on the flexible drive shaft 412. It should be understood that angles besides twenty to forty-five degrees may also be used.

The flexible drive shaft 412 penetrates the fan housing 404 at the hole 414 and curves inline with the gas stream in the axial direction. The flexible drive shaft 412 is protected by a coaxial tube 416 once the flexible drive shaft 412 enters the gas stream, and bearings are placed in the coaxial tube 416 to support the flexible drive shaft 412. It should be understood that the coaxial tube 416 and/or another element or seal may prevent gas or other contents of the housing 404 from escaping through the hole 414. A rectangular coaxial tube mount 418 is placed inside the fan housing 404 to stabilize the impeller 402 while in operation. The coaxial tube 416 and the mount 418 may be constructed of material that can withstand extreme temperatures and corrosive gasses, such as 316L SS, AL29-4C, and 14 gauge 6061T Aluminum, for example.

The ends of the housing 404 may be flanged to aid installation and maintenance of the draft inducer 400, and vee-bands or other appropriate fasteners may secure the draft inducer 400 to the duct system. If the draft inducer 400 needs to be removed, the user may loosens the vee-bands (or other fastener), and the draft inducer 400 may slide out from the duct system.

Figure 5:
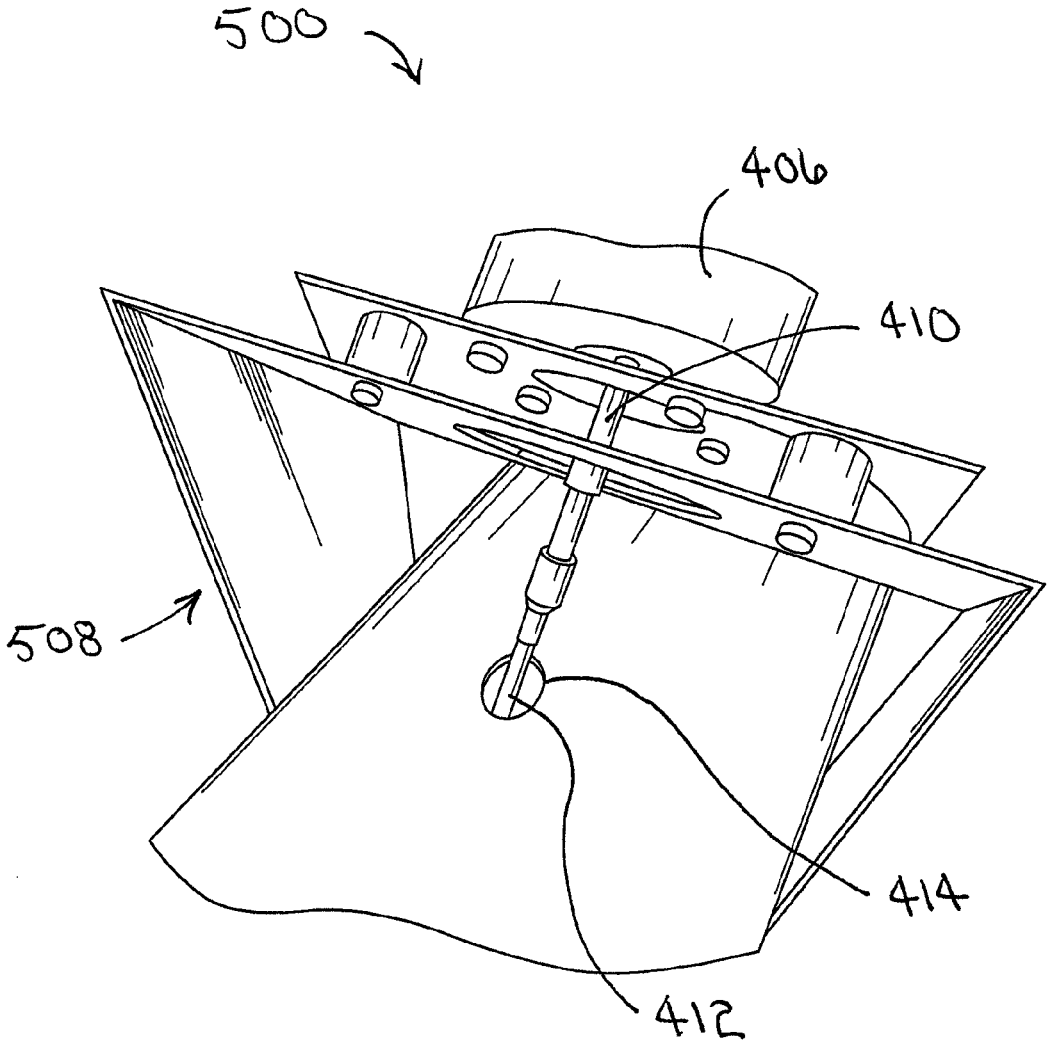
FIG. 5 shows a perspective view of a portion of a draft inducer according to another embodiment.

FIG. 5 shows a draft inducer 500 substantially similar to the draft inducer 400, except for as set forth herein, shown in the drawings, and/or inherent. Elements of the draft inducer 500 that are specifically discussed as being different from those of the draft inducer 400 may have reference numbers between 500 and 599; common elements/features may be referred to herein and in the drawings by the same reference numbers set forth above.

In the draft inducer 500, the mount 408 has been replaced by a mount 508. The mount 508 supports a different face of the motor 406 than does the mount 408, but the motor 406 is angled similarly relative to the housing 404 in both the draft inducer 500 and the draft inducer 400.

Figure 6B:
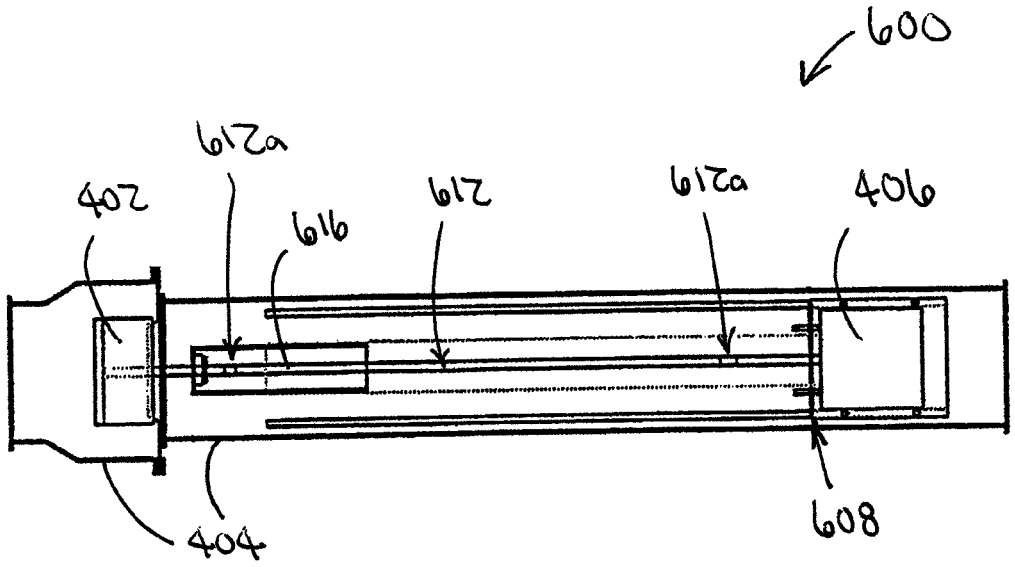
FIG. 6*b* shows a schematic top view of the draft inducer of FIG. 6*a*.
Figure 6A:
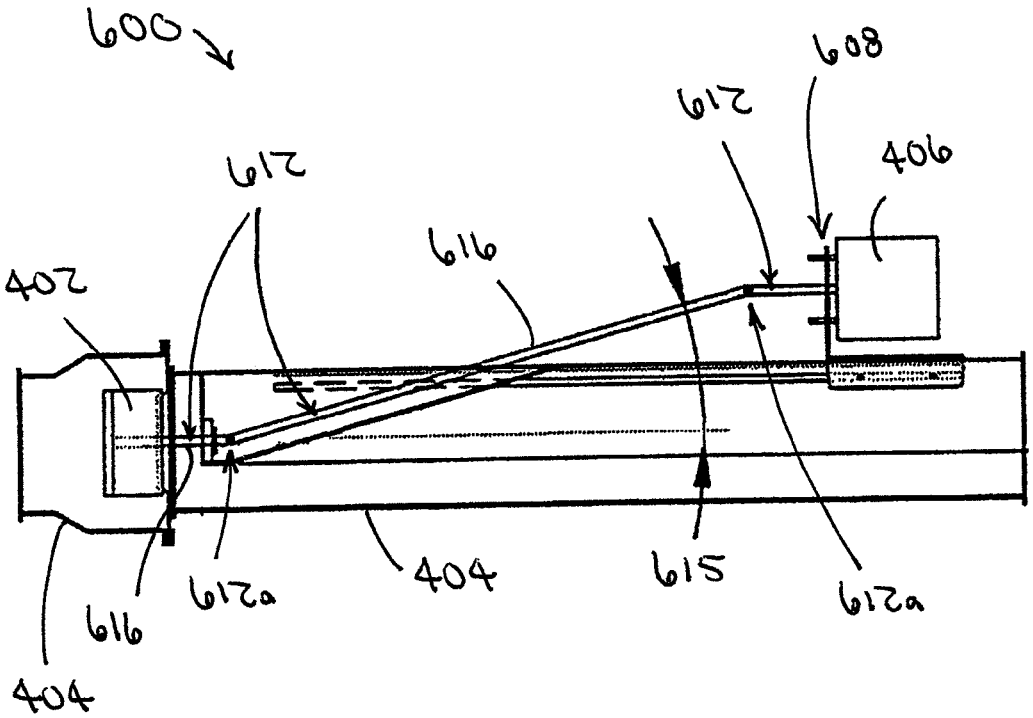
FIG. 6*a* shows a schematic side view of a draft inducer according to yet another embodiment.
Figure 6C:
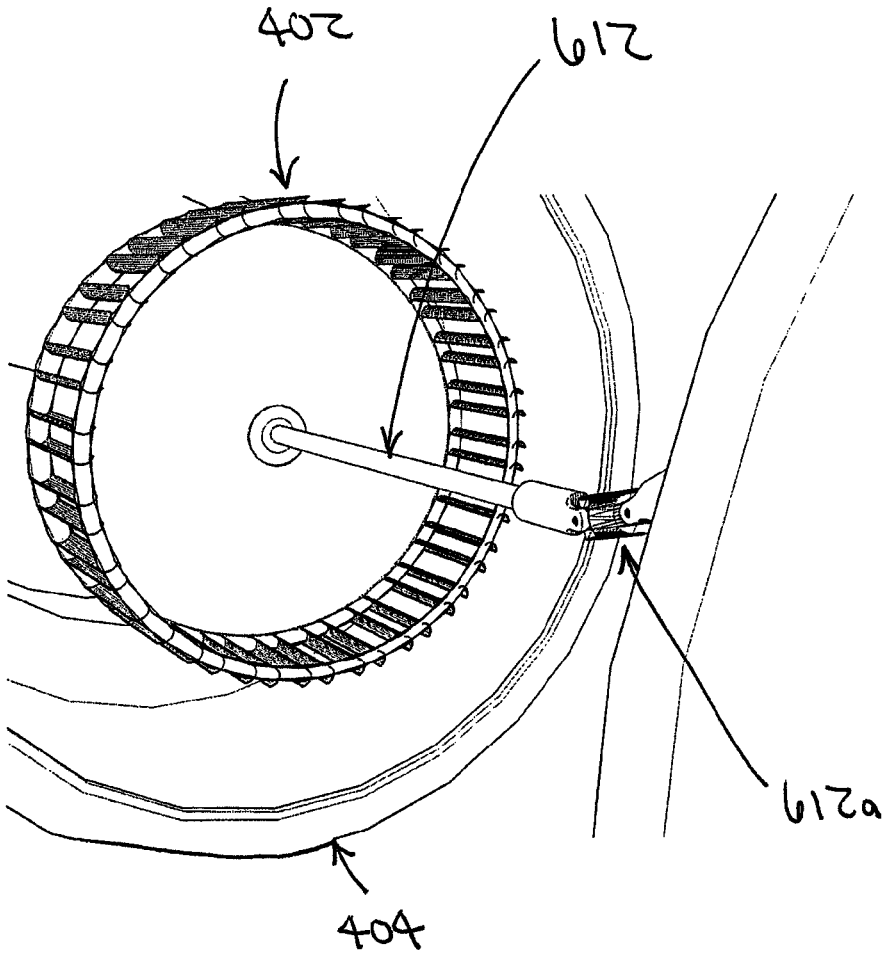
FIG. 6*c* shows a perspective view of a portion of the draft inducer of FIG. 6*a*.

FIGS. 6*a* through 6*c* show a draft inducer 600 substantially similar to the draft inducer 400, except for as set forth herein, shown in the drawings, and/or inherent. Elements of the draft inducer 600 that are specifically discussed as being different from those of the draft inducer 400 may have reference numbers between 600 and 699; common elements/features may be referred to herein and in the drawings by the same reference numbers set forth above.

In the draft inducer 600, the flexible drive shaft 412 has been replaced by a generally nonflexible drive shaft 612 having two universal joints 612*a* that allow the shaft 612 to rotate and transfer motion from the motor 406 to the impeller 402. Similar to the flexible drive shaft 412 in the draft inducer 400, the drive shaft 612 in the draft inducer 600 may be protected by a coaxial tube 616 in the gas stream, and bearings may be placed in the protective coaxial tube 616 to support the drive shaft 612. FIG. 6*c* shows one of the universal joints 612*a* (without the coaxial tube 616) and demonstrates that the drive shaft 612 may extend generally coaxially from the impeller 402 in the gas stream. While angle 615 is shown to be approximately fifteen degrees, other angles may also be appropriate.

Further, the motor 406 in the draft inducer 600 may be mounted so that the motor's output 410 is generally parallel to the axis of the impeller 402, as shown in FIG. 6*a*. In other words, the mount 408 has been replaced by a mount 608 that maintains the motor 406 in this configuration.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims.

We claim:

1. A draft inducer for use with a duct system exhausting corrosive and high temperature gas, comprising:

an inline tubular housing having first and second opposed ends respectively configured for attachment to the duct system, an imaginary center axis extending from the first end to the second end;

an impeller inside the housing, the impeller being supported by a mount located inside the housing and having an axis of rotation generally parallel to the imaginary center axis;

a motor mounted outside the housing such that an output of the motor is offset at an angle between twenty and sixty degrees relative to the imaginary center axis; and a drive shaft coupling the motor to the impeller to rotate the impeller with force from the motor, rotation of the impeller being in a direction such that gas is drawn past the motor and the drive shaft before reaching the impeller;

wherein the drive shaft passes through an opening in the housing, gas being unable to escape from the housing through the opening.

2. The draft inducer of claim 1, wherein the drive shaft includes at least one universal joint.

3. The draft inducer of claim 1, wherein the drive shaft is a flexible drive shaft or the drive shaft is a generally nonflexible drive shaft having at least one universal joint.

4. The draft inducer of claim 3, wherein a mount is attached to the housing and the motor is attached to the mount.

5. The draft inducer of claim 3, further comprising a coaxial tube protecting the drive shaft inside the housing.

6. The draft inducer of claim 5, further comprising bearings inside the coaxial tube to support the drive shaft.

7. The draft inducer of claim 6, wherein the impeller, coaxial tube, and housing are constructed of material to withstand high temperature and corrosive gasses.

8. The draft inducer of claim 7, wherein the material includes at least one of 316L SS, AL29-4C, and 14 gauge 6061T Aluminum.

9. A draft inducer for use with a duct system exhausting corrosive and high temperature gas, comprising:

an inline tubular housing have a first and second opposed ends respectively configured for attachment to the duct system, an imaginary center axis extending from the first end to the second end;

an impeller inside the housing, the impeller being supported by a mount located inside the housing and having an axis of rotation generally parallel to the imaginary center axis;

a motor outside the housing, the motor having an output that is not generally parallel to the center axis; and a drive shaft coupling the motor to the impeller to rotate the impeller with force from the motor, rotation of the impeller being in a direction such that gas is drawn past the motor and the drive shaft before reaching the impeller;

wherein the drive shaft passes through an opening in the housing, gas being unable to escape from the housing through the opening; and wherein the drive shaft is a flexible drive shaft, the flexible drive shaft being bent such that the flexible drive shaft bridges and transfers rotation between the motor and the impeller.

10. The draft inducer of claim 9, wherein the motor is mounted outside the housing between the housing ends such that an output of the motor is offset at an angle between twenty and sixty degrees relative to the imaginary center axis.

11. An exhaust fan assembly comprising:

a housing defining a chamber and having opposed openings, the openings having a centerline extending therebetween, a first of the openings being operative to intake a flow of gases, a second of the openings being operative to exhaust the flow of gases from the chamber; and a fan having a motor and an impeller operably coupled by a drive shaft, the motor being mounted external to the housing, the impeller being positioned within the chamber, the drive shaft extending through the housing at an angle to the centerline, the impeller being supported by a mount located inside the housing the rotational axis of the impeller being colliner with the centerline.

12. The draft inducer of claim 11, wherein the drive shaft includes two universal joints and the motor is mounted such that an output of the motor is generally parallel to an imaginary center axis of the impeller.

13. The exhaust fan assembly of claim 11, wherein the drive shaft extends through the housing at an angle between twenty and sixty degrees relative to the centerline.

14. The exhaust fan assembly of claim 11, wherein the drive shaft is a flexible drive shaft or the drive shaft has at least one universal joint.

15. The exhaust fan assembly of claim 11, wherein the motor is mounted external to the housing between the opposed openings.

16. A draft inducer for use with a duct system exhausting corrosive and high temperature gas, comprising:

a housing defining a chamber and having first and second opposed ends respectively configured for attachment to the duct system, the chamber having a central axis;

an impeller inside the chamber, the impeller having an axis of rotation generally parallel to the central axis;

a motor mounted outside the chamber; and a drive shaft coupling the motor to the impeller to rotate the impeller with force from the motor;

wherein the drive shaft passes through an opening in the housing, gas being unable to escape from the housing through the opening, the drive shaft extending through the opening in a direction that is not generally parallel to the central axis.

17. The draft inducer of claim 16, wherein the drive shaft extends through the opening at an angle between twenty and sixty degrees relative to the central axis.

18. The draft inducer of claim 17, wherein the motor is mounted outside the housing between the housing ends.

19. The draft inducer of claim 18, wherein the drive shaft is a flexible drive shaft or the drive shaft has at least one universal joint.

20. The draft inducer of claim 16, wherein the drive shaft is a flexible drive shaft or the drive shaft has at least one universal joint.

* * * * *